United States Patent [19]

Cotta

[11] Patent Number: 4,717,060

[45] Date of Patent: Jan. 5, 1988

[54] SELF-CONTAINED INTERNAL COMBUSTION FASTENER DRIVING TOOL

[75] Inventor: Gilbert A. Cotta, Cincinnati, Ohio

[73] Assignee: Senco Products, Inc., Cincinnati, Ohio

[21] Appl. No.: 881,339

[22] Filed: Jul. 2, 1986

[51] Int. Cl.[4] ..... B25C 1/08

[52] U.S. Cl. ..... 227/10; 227/120

[58] Field of Search ..... 227/8, 9, 10, 120, 136

[56] References Cited

U.S. PATENT DOCUMENTS

| | | | |
|---|---|---|---|
| 3,042,008 | 7/1962 | Liesse | 227/10 X |
| 4,200,213 | 4/1980 | Liesse | 227/10 |
| 4,403,722 | 9/1983 | Nikolich | 227/8 |
| 4,483,473 | 11/1984 | Wagdy | 227/8 |
| 4,657,166 | 4/1987 | Anstett | 227/120 X |

*Primary Examiner*—Paul A. Bell

*Attorney, Agent, or Firm*—Frost & Jacobs

[57] ABSTRACT

A fastener driving tool powered by internal combustion of an air/fuel mixture. A tool body has located therein upper and lower coaxial cylinders containing upper and lower pistons, respectively, attached to a common driver and forming a piston/driver assembly shiftable between a normal retracted position and an extended fastener driving position. A combustion chamber at the upper end of the lower cylinder and having an ignition device therein. The tool body contains a combustion air chamber and at least one return air chamber, together with a source of gaseous fuel. A trigger actuated control valve is configured to introduce a measured air/fuel mixture from the combustion air chamber and the source of gaseous fuel into the combustion chamber, to actuate the ignition means to combust the air/fuel mixture and shift the piston/driver assembly to its extended position, to introduce air from the at least one return air chamber to the upper cylinder beneath the upper piston to return the piston/driver assembly to its normal position, to exhaust the combustion chamber and to replenish air in the combustion air chamber and the at least one return air chamber.

34 Claims, 13 Drawing Figures

9
9
8
1
2a
18
3
7
2
11
11
4
17
18
105
16
16
2b
97
96
14
93
15
10
11
11
12
12
6
15
13
5
13

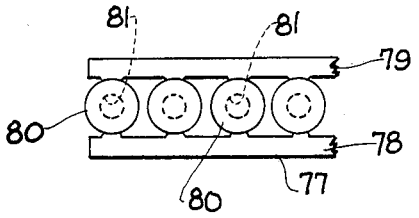
FIG. 13
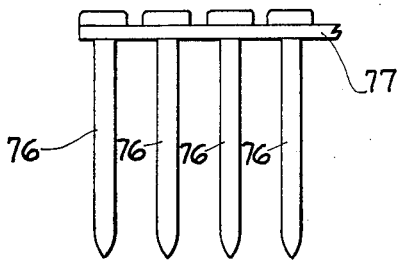
FIG. 12
FIG. 9
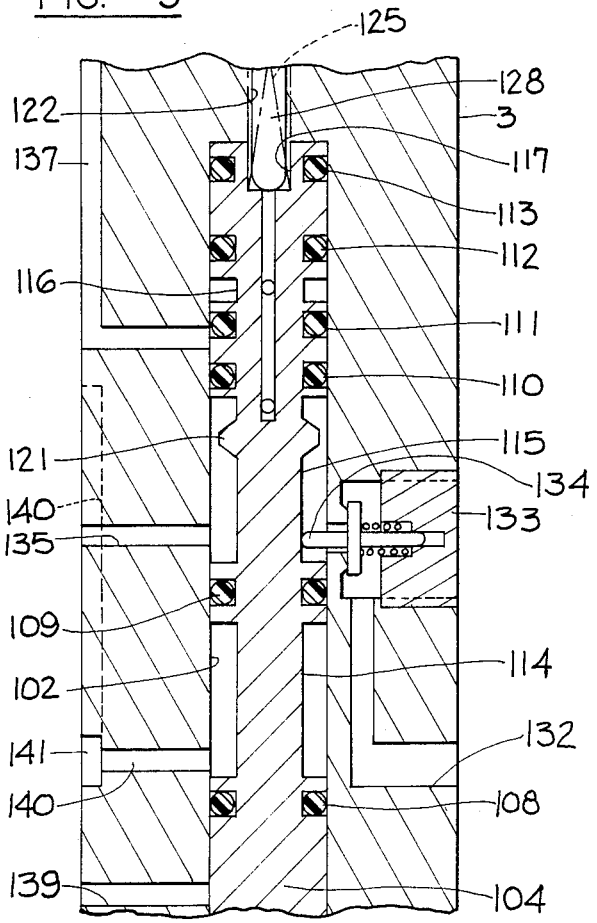

SELF-CONTAINED INTERNAL COMBUSTION FASTENER DRIVING TOOL

REFERENCE TO RELATED APPLICATIONS

The present invention is related to co-pending application Ser. No. 881,343 filed 7-2-86, in the name of the same inventor and entitled CAM-CONTROLLED SELF-CONTAINED INTERNAL COMBUSTION FASTENER DRIVING TOOL; and to co-pending application Ser. No. 881,337, filed July 2, 1986 in the name of the same inventor and entitled SIMPLIFIED SELF-CONTAINED INTERNAL COMBUSTION FASTENER DRIVING TOOL.

TECHNICAL FIELD

The invention relates to a fastener driving tool, and more particularly to a self-contained fastener driving tool powered by the internal combustion of a mixture of fuel and air.

BACKGROUND ART

The majority of fastener driving tools in use today are pneumatically actuated tools. Pneumatic fastener driving tools have been developed to a high degree of sophistication and efficiency, but require a source of air under pressure and are literally tied thereto by hose means. Under some circumstances, particularly in the field, a source of air under pressure is not normally present and is expensive and sometimes difficult to provide.

Prior art workers have also developed a number of electro-mechanical fastener driving tools, usually incorporating one or more flywheels with one or more electric motors therefor. Such tools require a source of electrical current normally present at the job site. Nevertheless, such tools are also quite literally "tied" to a power source.

Under certain circumstances, it is desirable to utilize a completely self-contained fastener driving tool, not requiring a source of air under pressure or a source of electrical current. To this end, prior art workers have devised self-contained fastener driving tools powered by internal combustion of a gaseous fuel/air mixture. It is to this type of tool that the present invention is directed.

Exemplary prior art internal combustion fastener driving tools are taught, for example, in U.S. Pat. Nos. 2,898,893; 3,042,008; 3,213,607; 3,850,359; 4,075,850; 4,200,213; 4,218,888; 4,403,722; 4,415,110; and European Patent Application Nos. 0 056 989; and 0 056 990. While such tools function well, they are usually large, heavy and awkward to use.

The fastener driving tool of the present invention comprises a self-contained internal combustion tool which is compact, easy to manipulate and simple in construction. The fastener driving tool is highly efficient, operating on a high compression ratio to convert most of the fuel energy into useful work. The fastener driving tool utilizes a pair of coaxial upper and lower cylinders each having a piston mounted on a common driver, and a straightforward control valve to sequence the feed of a predetermined fuel/air mixture into a combustion chamber, to combust the fuel mixture, shifting the driver and driving a fastener into a workpiece, to return the pistons and driver to their normal unactuated positions and to purge spent products of combustion from the combustion chamber. The tool also compresses and stores sufficient fresh air for the next cycle.

DISCLOSURE OF THE INVENTION

According to the invention there is provided a fastener driving tool which is self-contained and uses internal combustion of an air/gaseous fuel mixture as its driving force. The tool comprises a main housing having upper and lower portions, a main valve housing, a handle, a guide body affixed to the lower housing portion and a fastener-filled magazine connected to and supported at one end by the guide body and supported at its other end by a bracket depending from the handle.

The upper body portion contains an upper cylinder and a surrounding combustion air chamber together with a surrounding upper return air chamber. The lower body portion contains a lower cylinder with a surrounding lower return air chamber. An upper piston for the upper cylinder and a lower piston for the lower cylinder are both mounted on a common fastener driver, forming a piston/driver assembly. A combustion chamber is located at the upper end of the lower cylinder. A main control spool valve is located in the main valve housing and is shiftable between an unactuated position and an actuated position by a manual trigger, and is biased to its unactuated position. A gaseous fuel container is located in the tool handle and is connected to the main valve by a one-way fuel valve delivering a measured volume of fuel thereto. A piezoelectric device is connected to a spark plug in the combustion chamber. The combustion chamber is connected to exhaust via an exhaust valve.

The main valve when shifted by the manual trigger from its unactuated position to its actuated position is operative to actuate the fuel valve and introduce a measured amount of fuel into the combustion chamber, followed by air from the combustion air chamber. When the main valve achieves its actuated position, it activates the piezoelectric device igniting the fuel/air mixture in the combustion chamber, causing the piston/driver assembly to shift downwardly from a normal retracted position to an actuated fastener driving position, driving the forwardmost fastener of the magazine, located in the guide body, into a workpiece. During the downward movement of the upper piston, air beneath the upper piston fills the upper combustion air chamber and the upper return air chamber. Similarly, air beneath the lower piston, during its downward movement, fills the lower return air chamber. When the trigger is released and the main valve shifts to its unactuated position, the main valve is operative to introduce air from the upper and lower return air chambers to the upper cylinder beneath the upper piston, to shift the piston/driver assembly to its normal retracted position. Simultaneously, the main valve actuates the exhaust valve to exhaust products of combustion from the lower cylinder above the lower piston and the combustion chamber, so that the tool is ready for its next cycle.

BRIEF DESCRIPTION OF THE DRAWINGS

FIG. 9 is a fragmentary cross-sectional view through the main valve housing and the main valve spool, illustrating the main valve spool in its uppermost, fully actuated position.

FIG. 12 is a fragmentary plan view of an exemplary strip of fasteners such as nails or studs.

FIG. 13 is a fragmentary elevational view of the strip of fasteners of FIG. 12.

DETAILED DESCRIPTION OF THE INVENTION

Figure 1:
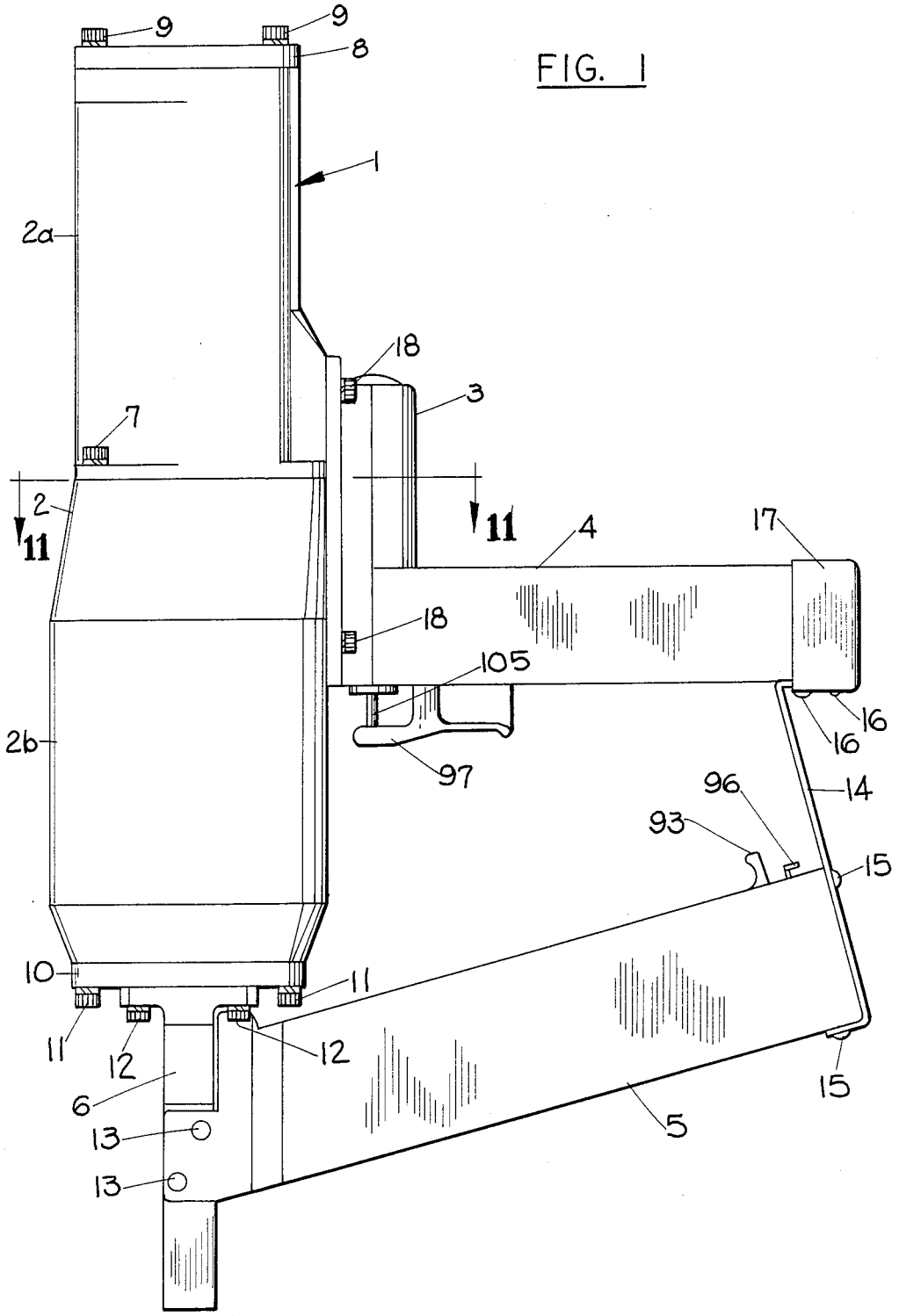
FIG. 1 is a side elevational view of the self-contained internal combustion fastener driving tool of the present invention.

In all of the figures, like parts have been given like index numerals. Reference is first made to FIGS. 1–5. In these figures, the tool of the present invention is generally indicated at 1. The tool 1 comprises a main housing 2 having an upper portion 2*a* and a lower portion 2*b*. The tool 1 further comprises a main valve housing 3, a handle 4, a magazine 5 and a nose portion or guide body 6.

The main body upper portion 2*a* is affixed to the main body lower portion 2*b* by a series of bolts, some of which are shown at 7. The upper end of the main body upper portion is provided with a cap 8 affixed thereto by bolts 9. The lower end of the main body lower portion 2*b* is provided with an end plate 10, affixed thereto by bolts 11. The guide body 6 is mounted on plate 10 by bolts 12.

The forward end of magazine 5 is mounted to guide body 6 by machine screws 13. The rearward end of magazine 5 is affixed to the rearward end of handle 4 by a bracket or hanger 14. Hanger 14 is affixed to the rearward end of magazine 5 by machine screws 15, and to the rearward end of the handle 4 by machine screws 16.

As will be apparent hereinafter, the handle 4 is a hollow member, the rearward end of which is closed by a hinged end cap 17. The forward end of handle 4 is affixed to the main valve body 3. The main valve body 3, in turn, is affixed to the main tool body 2 by bolts 18. A gasket (not shown) is mounted between the main valve body 3 and the main tool body 2 to form a seal therebetween.

Figures 6, 10:
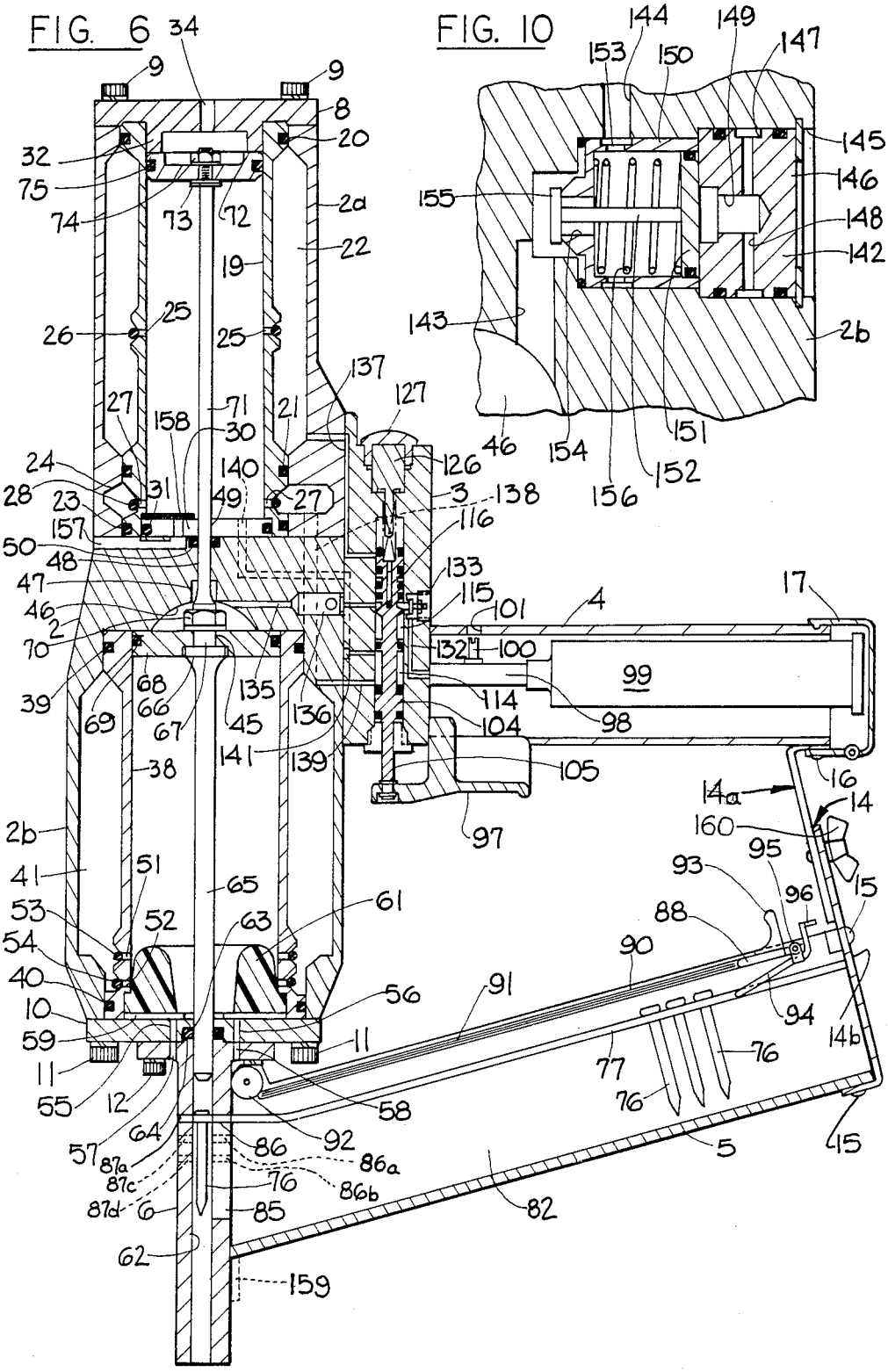
FIG. 6 is a cross-sectional elevational view of the tool of FIG. 1, illustrating the valve spool and trigger in their normal, lower, unactuated positions and the charging piston and driving piston in their normal upper positions.
FIG. 10 is an enlarged cross-sectional view through the exhaust valve of the tool of the present invention.

Reference is now made to the cross-sectional view of FIG. 6. The upper portion 2*a* of the main tool body 2 surrounds an upper cylinder 19. The upper cylinder 19 carries O-rings 20 and 21 which sealingly engage the inside surface of upper body portion 2*a*, defining an annular combustion air chamber 22. The upper cylinder 19 also carries an O-ring 23. The seals made by O-rings 21 and 23 define a sealed, annular, upper return air chamber 24. At about its longitudinal center, the upper cylinder 19 is provided with a plurality of radial perforations 25 sealed by an O-ring 26. The O-ring 26 serves as a one-way check valve. Similarly, at its lower end, the upper cylinder 19 has a plurality of radial perforations 27 with an O-ring 28, serving as a one-way check valve.

At its lower end, upper cylinder 19 is provided with a plate 30. The plate 30 has a peripherally mounted O-ring 31 which sealingly engages the inside surface of upper cylinder 19. At the upper end of the upper body portion 2*a*, the cap 8 is provided with a downwardly depending, annular flange 32. The flange 32 is received within the upper end of upper cylinder 19. The cap 8 has an ambient air inlet bore or port 34 (see also FIG. 4). The inlet bore 34 communicates with the environment.

The lower portion 2*b* of main body 2 surrounds a lower cylinder 38. The lower cylinder 38 carries at its ends peripherally mounted O-rings 39 and 40 which sealingly engage the inside surface of the lower body portion 2*b* and which define a sealed annular lower return air chamber 41.

At its upper end, the lower cylinder 38 abuts the inside surface of the lower body portion 2*b*. Near its upper end, the lower body portion 2*b* has a dome-shaped depression formed therein. This depression constitutes part of the combustion chamber 46. In the central portion of combustion chamber 46, the lower body portion 2*b* has a bore comprising a large diameter portion 47, followed by a smaller diameter portion 48. The purpose of the bore portions 47 and 48 will be apparent hereinafter. The plate 30 has a central bore 49, coaxial with the bore portions 47 and 48 of the lower body portion 2*b*. An annular O-ring 50 creates a seal between the upper surface of the lower body portion 2*b* and the plate 30, about the bore portion 48.

At its lower end, the lower cylinder 38 has two annular rows of radial bores 51 and 52. The bores 51 and 52 communicate between the interior of lower cylinder 38 and the lower return air chamber 41. The bores 51 are provided with an O-ring 53 and the bores 52 are similarly provided with an O-ring 54. O-rings 53 and 54 serve as one-way check valves.

The plate 10, at the bottom end of the lower body portion 2*b* has a pair of ambient air inlet bores 55 and 56. The guide body 6 is provided with a matching pair of ambient air inlet bores 57 and 58. The bore 57 is coaxial with the bore 55 and the bore 58 is coaxial with the bore 56. The ambient air inlet bores 55,57 and 56,58 are normally closed by a resilient reed spring valve 59. The resilient reed valve is circular and overlies plate 10. Mounted on plate 10, above reed valve 59 is a resilient, annular bumper 61, the purpose of which will be apparent hereinafter. The guide body 6 has a longitudinal slot or bore 62 constituting a drive track for the driver of the tool (to be described hereinafter) and for the fastening means (also to be described hereinafter). The drive track 62 mates with an opening 63 in plate 10. An O-ring 64 creates a seal between guide body 6 and plate 10, and between these elements and the driver.

As indicated above, the tool 1 of the present invention may be used to drive any appropriate type of fastening means including studs, nails, staples and the like. For purposes of an exemplary showing, the tool is illustrated in an embodiment suitable for driving studs. To this end, the driver 65 comprises a rod-like element. In FIG. 6, the driver 65 is shown in its normal, retracted position with its lowermost end creating a seal with O-ring 64 and entering drive track 62 in guide body 6. The driver 65 has an outwardly flaring portion 66, surmounted by a portion 67 of lesser diameter. The portions 66 and 67 pass through and support a driving or lower piston 68. The lower piston 68 has a peripherally mounted O-ring 69 in sealing engagement with the interior surface of lower cylinder 38. The upper part of driver portion 67 is threaded and is engaged by a nut 70 which rigidly affixes the lower piston 68 to the driver. The driver 65 has an upward extension 71 which passes through the bore portions 47 and 48 of the lower main body portion **2*b* and through the bore 49 of plate 30 upwardly into the upper cylinder 19. Driver extension 71 is sealingly engaged by O-ring 50. The uppermost end of the driver extension 71 is threaded and passes through the center of a charging or upper piston 72. The upper threaded portion of driver extension 71 carries a washer 73 and a nut 74 by which the upper piston 72 is rigidly mounted on the driver extension 71. The upper piston 72 has a peripherally mounted O-ring 75 in sealing engagement with the inside surface of upper cylinder 19. It will be understood that the configuration of driver 65 and the nature of magazine 5 can vary, depending upon the type of fastener to be driven by tool 1**.

Reference is now made to FIGS. 6, 12 and 13. The exemplary fasteners are illustrated in FIGS. 6 and 12 as headed studs 76 supported by an elongated plastic strip 77. The plastic strip 77 is shown in FIG. 13. The plastic strip 77 is an integral one-piece structure comprising two elongated ribbon-like members 78 and 79 joined by circular washer-like members 80. The washer-like members 80 have central perforations 81 sized to just nicely receive the shanks of the studs 76. When each stud is driven, in its turn, by driver 65, its respective washer-like structure 80 will break away from the ribbon-like members 78 and 79 and remain with the stud.

Figure 2:
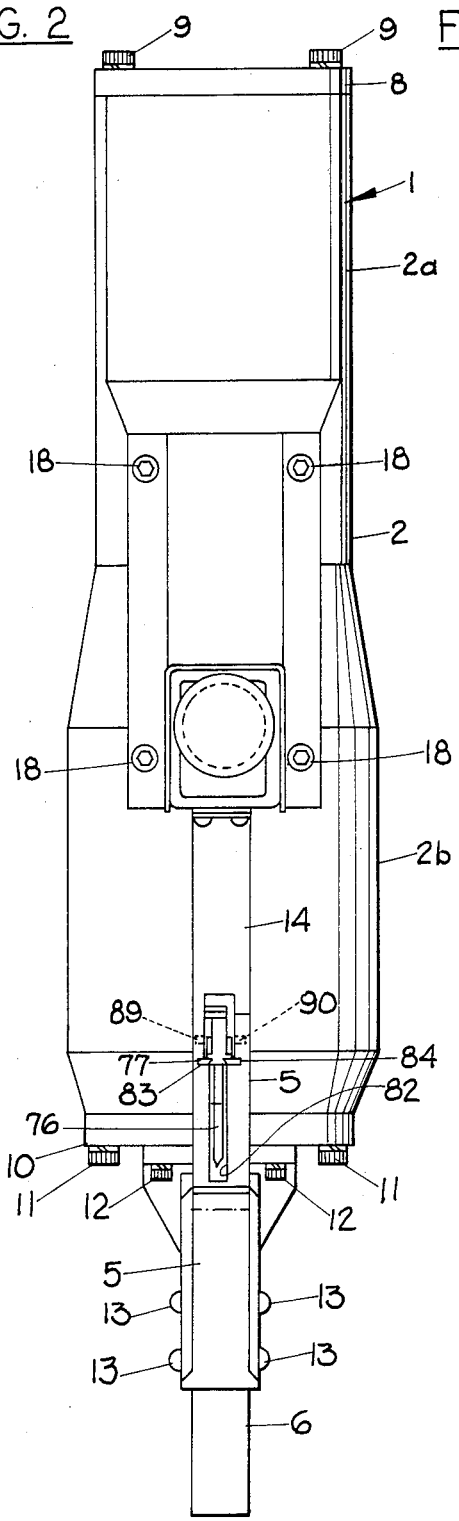
FIG. 2 is a rear elevational view with the end cap removed to expose the fuel can.
Figure 3:
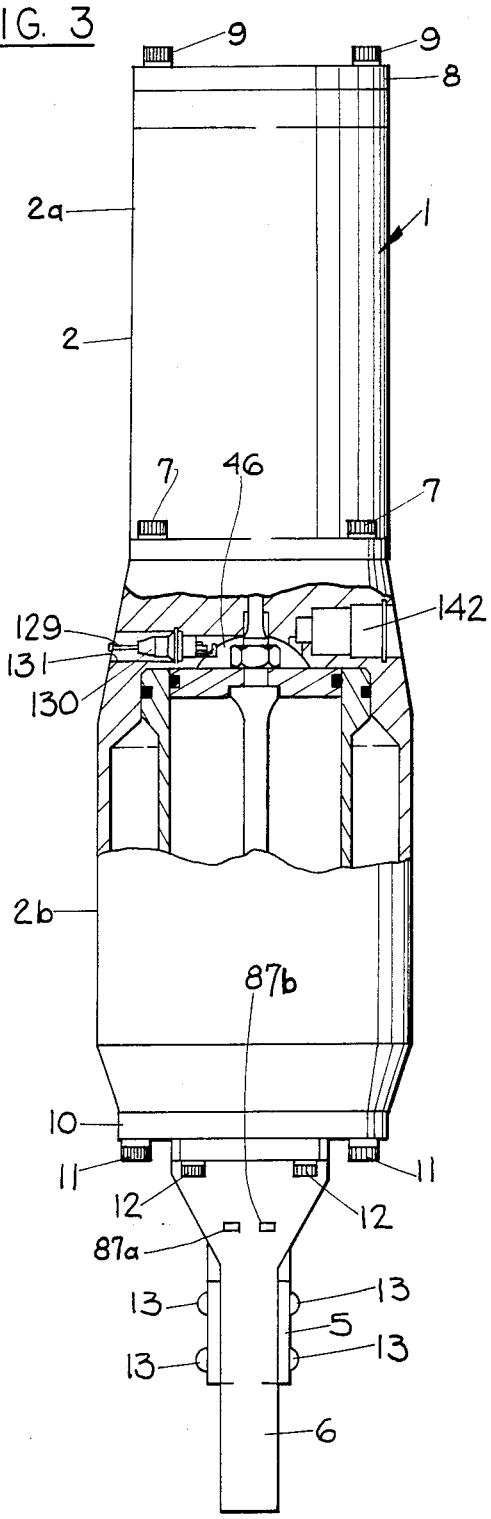
FIG. 3 is a front elevational view of the tool of FIG. 1 partly in cross section to reveal the spark plug and exhaust valve.

Reference is now made to FIGS. 2 and 6. The magazine 5 has a central opening 82 extending longitudinally thereof and accommodating the studs 76. The opening 82 is flanked on each side by shallow transverse slots 83 and 84, also extending longitudinally of the magazine. The ribbon-like portions 78 and 79 of strip 77 are slidably received in the slots 83 and 84, respectively. The rearward wall of guide body 6 has a slot 85 formed therein corresponding to the opening 82 of magazine 5. The guide body slot 85 is intersected by a pair of transverse slots, one of which is shown at 86, corresponding to the transverse slots 83 and 84 in the magazine 5. The forward wall of guide body 6 has a pair of transverse slots **87*a* and 87*b* formed therein (see also FIG. 3). These slots are larger in size than ribbons 78 and 79. The transverse slots 87*a* and 87*b* are equivalent to both transverse slots in the rear wall of the guide body, one of which is shown at 86 in FIG. 6**.

From the above description it will be apparent that the studs supported by strip 77 are slidably supported within magazine 5, with the studs depending downwardly in opening 82. The forwardmost stud of the strip enters guide body 6 via corresponding slot 85 in the rear wall of the guide body. The forwardmost stud is properly located under the driver by virtue of its respective washer. Once the stud has been driven by driver 65, the strip 77 will advance in the magazine and guide body with the scrap portion 78, 79 of the strip passing out through guide body slots **87*a* and 87*b***.

Any appropriate means can be used to advance strip 77 through the magazine 5 and to constantly urge the forwardmost stud of the strip into the guide body drive track 62. For purposes of an exemplary showing, a feeder shoe 88 is illustrated in FIG. 6. The feeder shoe 88 is slidably mounted in transverse slots 89 and 90 in the magazine (see also FIG. 2). The feeder shoe 88 is operatively attached to a ribbon-like spring 91 located in an appropriate socket 92 at the forward end of magazine 5. In this way, the feeder shoe 88 is constantly urged forwardly in the magazine, and as a result, constantly urges the stud supporting ribbon 77 forwardly. The feeder shoe 88 has a handle portion 93 by which it may be easily manually retracted during the magazine loading operation. The feeder shoe also pivotally mounts a lug 94. A spring (not shown) is mounted about pivot pin 95 with one leg of the spring abutting feeder shoe 88 and the other abutting the lug 94 to maintain the lug 94 in its downward position as shown in FIG. 6. In its downward position, the lug 94 abuts the rearward end of strip 77, enabling the feeder shoe (under the influence of spring 91) to urge the strip 77 forwardly. The lug 94 has an integral upstanding handle 96 by which it can be pivoted upwardly toward the feeder shoe and out of the way during loading of the magazine 5.

The hollow handle 4 slidably mounts a trigger 97. The hollow handle 4 also contains a tube 98 extending longitudinally thereof from main valve body 3. The free end of tube 98 (not shown) is threaded and is adapted to be threadedly engaged by the outlet of a gaseous fuel canister 99. When the canister 99 is threadedly engaged on tube 98, the threaded end of the tube 98 opens a spring loaded valve in the canister. The tube 98 contains a pressure regulating needle valve 100, accessible for adjustment through an opening 101 in handle 4 (see also FIG. 4).

Figure 7:
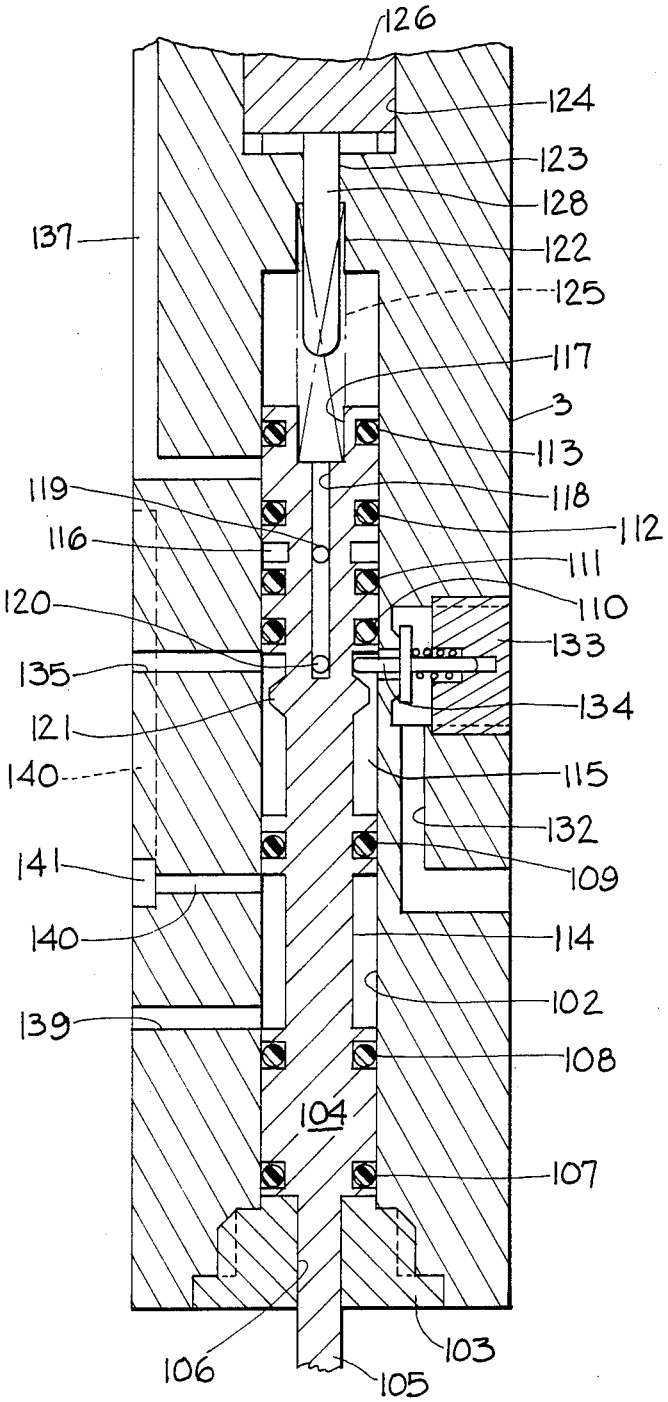
FIG. 7 is a fragmentary cross-sectional view through the main valve housing and the main valve spool, showing the main valve spool in its lower, unactuated position.

Reference is now made to FIGS. 6 and 7, wherein the main valve housing 3 is shown. A gasket (not shown) is located between main body 2 and the main valve housing 3 to seal the various passages therein (to be described) one from the others. The main valve housing has a cylindrical valve chamber 102 formed therein. The bottom end of the valve chamber is closed by a threaded nut 103. A main control valve spool 104 is slidably mounted in the valve chamber 102. The spool has an elongated extension 105 at its lowermost end, passing through a perforation 106 in the nut 103. As is shown in FIG. 6, the free end of extension 105 is operatively connected to trigger 97.

Main valve spool 104 is provided with a plurality of O-rings 107 through 113, sealingly engaging the inside surface of the main valve chamber 102. Main valve spool 104 has three annular grooves 114, 115 and 116. The purpose of these grooves will be apparent hereinafter. At its uppermost end, the main valve spool 104 has a large axial bore 117 leading to axial bore 118 of lesser diameter. A transverse bore 119 connects the axial bore 118 with the annular groove 116. In similar fashion, a transverse bore 120 connects the axial bore 118 with the annular groove 115. The main valve spool 104 has an annular cam surface 121, the purpose of which will be apparent hereinafter.

The upper portion of main valve housing 3 has a bore 122 of lesser diameter than the main valve bore or chamber 102, surmounted by a bore 123 of yet lesser diameter. The bore 123, in turn, is surmounted by a bore 124 of greater diameter. The bores 122, 123 and 124 are coaxial with the main valve chamber or bore 102.

Figure 4:
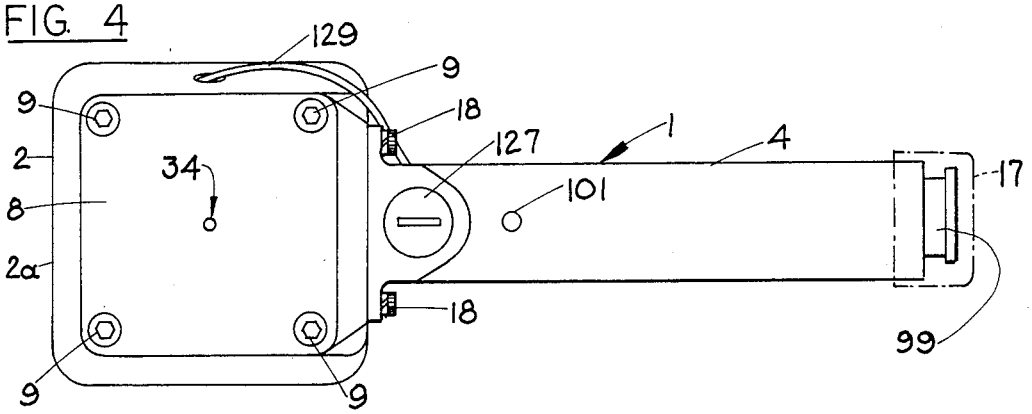
FIG. 4 is a plan view of the tool of FIG. 1 with the end cap shown in broken lines.
Figure 5:
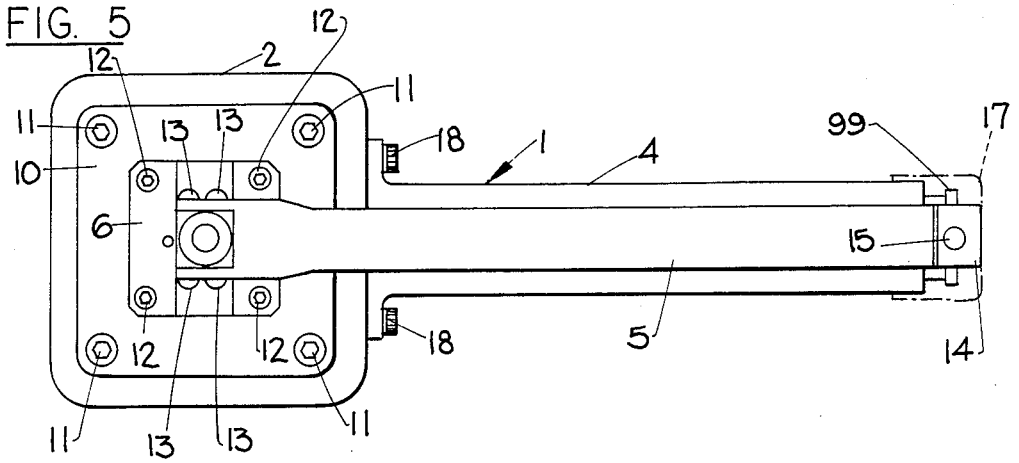
FIG. 5 is a bottom view of the tool of FIG. 1 with the end cap shown in broken lines.

A coiled compression spring 125 is provided with its lowermost end abutting the end of main valve stem bore 117 and its upper end abutting the end of main valve housing bore 122. The spring 125 biases the main valve stem 104 and trigger 97 to their unactuated, lowermost positions shown in FIGS. 6 and 7. The bore 124 also houses a conventional piezoelectric device, held in place by a threaded cap 127 (see FIG. 6). The piezoelectric device 126 has an actuating plunger 128 extending through main valve housing bores 123 and 122, into the main valve chamber or bore 102. As is shown in FIGS. 4 and 11, the piezoelectric device 126 is connected by a wire 129 to a spark plug 130, mounted in a bore 131 in the lower body portion **2*b*, with its spark generating end in combustion chamber 46**.

As is most clearly shown in FIGS. 6 and 7, the tube 98 leading from the gaseous fuel canister 99 is connected to the main valve bore 102 by a passage 132, formed in the main valve housing 3. The passage 132 is provided with a one-way fuel valve 133, having a nose 134 extending into the main valve chamber or bore 102 and adapted to cooperate with the annular cam 121 of main valve stem 104. A passage 135, formed in the lower body portion **2*b* and the main valve housing 3 leads from the main valve chamber or bore 102 to the combustion chamber 46. The passage 135 has a check valve 136 located therein (see FIG. 6). The combustion air chamber 22 is connected to the main valve chamber or bore 102 by a passage 137 formed in the upper portion 2*a* of the main body 2 and the main valve housing 3**.

The upper return air chamber 24 and the lower return air chamber 41 are connected together by a passage 138 formed in the lower portion **2*b* and in the upper portion 2*a* of the main body 2. The passage 138 (and thus the upper return air chamber 24 and the lower return air chamber 41) is connected to the main valve chamber or bore 102 by a passage 139, formed in both the lower portion 2*b* of the main body 2 and the main valve housing 3. A passage 140 connects the main valve chamber or bore 102 with the lower end of upper cylinder 19, being formed in the main valve housing 3, the lower body portion 2*b* and the plate 30**.

Figure 11:
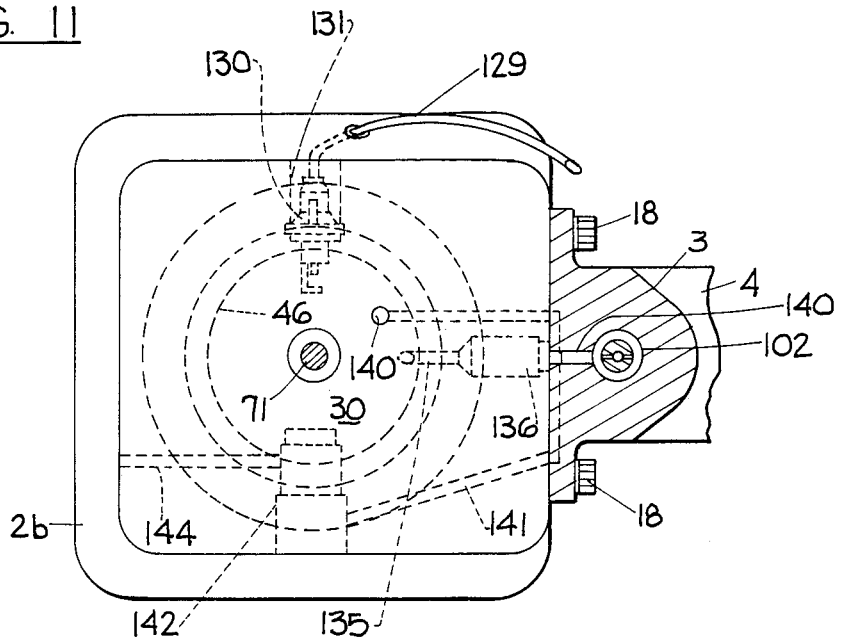
FIG. 11 is a fragmentary, cross-sectional view taken along section line 11—11 of FIG. 1.

As is best shown in FIG. 11, a passage 141 branches from passage 140 and leads to an exhaust valve 142. The passage 141 is formed in the main valve housing 3 and the lower body portion **2*b*. Referring now to FIGS. 10 and 11, the exhaust valve 142 is connected to the combustion chamber 46 by a passage 143 formed in the lower body portion 2*b* and is also connected to an exhaust port (not shown) by a passage 144 formed in the lower body portion 2*b*. The exhaust valve 142 is located in a bore 145 formed in the side of the lower body portion 2*b*. The exhaust valve comprises a sealed plug 146 having an annular groove or passage 147 formed therein. The passage 141 (see FIG. 11) communicates with the annular passage 147. The passage 147, in turn, communicates with a transverse bore 148, intersecting an axial bore 149. The forward portion of exhaust valve 142 comprises a cylinder 150 having a piston 151 and a piston rod 152. The cylinder 150 has a perforation 153 communicating with the exhaust passage 144 and a bore 154 communicating with the passage 143 leading to combustion chamber 46. The bore 154 is normally closed by a valve element 155 affixed to the piston rod 152. A compression spring 156 urges the piston 151 toward the right as viewed in FIG. 10 and the valve element 155 to its closed position with respect to bore 154. It will be understood that air under pressure in passage 141, annular passage 147, transverse bore 148 and axial bore 149 will cause the piston 151 and the valve element 155 to shift to the left as viewed in FIG. 10. This will cause the passage 143 leading from combustion chamber 46 to communicate with exhaust passage 144 through cylinder 50**.

To complete the tool 1, a vent passage 157 is formed in the lower body portion **2*b* and the plate 30 at the bottom of upper cylinder 19 (see FIG. 6). The vent passage 157 leads from the outside of the tool 1 to the bottom of upper cylinder 19. The vent passage is normally closed by a reed valve 158**.

TOOL OPERATION

The tool 1 of the present invention having been described in detail, its operation can now be set forth as follows. Reference is first made to FIGS. 6 and 7 wherein the tool and its various elements are shown in their normal, unactuated conditions.

The cap 17 is swung to its open position and a gaseous fuel canister 99 is threadedly engaged with the tube 98. The pressure regulating needle valve is adjusted, if required. It will be understood that that portion of tube 98 and passage 132 extending between regulator valve 100 and one-way fuel valve 133 is filled with gaseous fuel. This portion of tube 98 and passage 132 is so sized as to accommodate a measured fuel charge for one cycle of tool 1.

For its initial use, or if the tool has not been used for some time, it may be necessary to prime the tool to assure that the combustion air chamber 22 contains air at the required pressure level. This can be done by adjusting regulator valve 100 to the desired level of fuel gas flow and firing the tool several times before the loading of the magazine 5. Another way to prime the tool is by inserting a rod into drive track 62 and attaching it to driver 65 (by a threaded engagement or other appropriate means) and moving the driver 65 and its extension 71 up and down several times, manually.

The feeder shoe 88 is grasped by its handle portion 93 and pulled rearwardly of magazine 5. The lug 94 is shifted out of the way by its handle portion 96 and a strip 77 carrying a plurality of studs 76 is loaded into magazine 5, with the forwardmost nail being located in the drive track 62 of guide body 6.

When it is desired to actuate the tool, the guide body is located against the workpiece at a position where it is desired to drive a stud, and the trigger 97 is actuated by the operator. It will be apparent from FIGS. 6 and 7 that as the main valve spool 104 shifts upwardly (as viewed in these figures) under the influence of trigger 97, passages 139 and 141 will be closed and the annular cam 121 on spool 104 will contact the nose 134 of one-way fuel valve 133, opening valve 133. This will allow the metered amount of fuel in passage 132 to pass through the main valve chamber or bore 102 at the annular groove 115 in the main valve spool 104 and through passage 135 and check valve 136 into combustion chamber 46. As soon as annular cam 121 of main valve spool 104 no longer contacts the one-way fuel valve nose 134, the one-way fuel valve 133 will close. Continued upward movement of the main valve spool 104 will cause the annular groove 116 of the spool to align with passage 137 from combustion air chamber 22.

The combustion air, under pressure, will be released and will pass through passage 137, the annular groove 116 in the main valve spool 104, through the transverse spool bore 119, the axial spool bore 118 and the transverse spool bore 120 to the main valve bore or chamber 102 at the annular groove 115 in the main valve spool 104. Thence, the combustion air passes through passage 135 and its check valve 136 into the combustion chamber 46. This will cause the piston 68 and driver 65 to shift slightly downwardly in lower cylinder 38 until the free end of driver 65 contacts the head of the stud 76 located in drive track 62. At this point, the proper mixture of air and fuel is present in combustion chamber 46. The mixture at this point is under high compression ratio (for example, about 4:1 and preferably about 6:1 or more) and the strip 77 is designed to withstand the load caused by the fuel mixture pressure. The high compression ratio assures the most complete burning and the most efficient use of the fuel.

Figure 8:
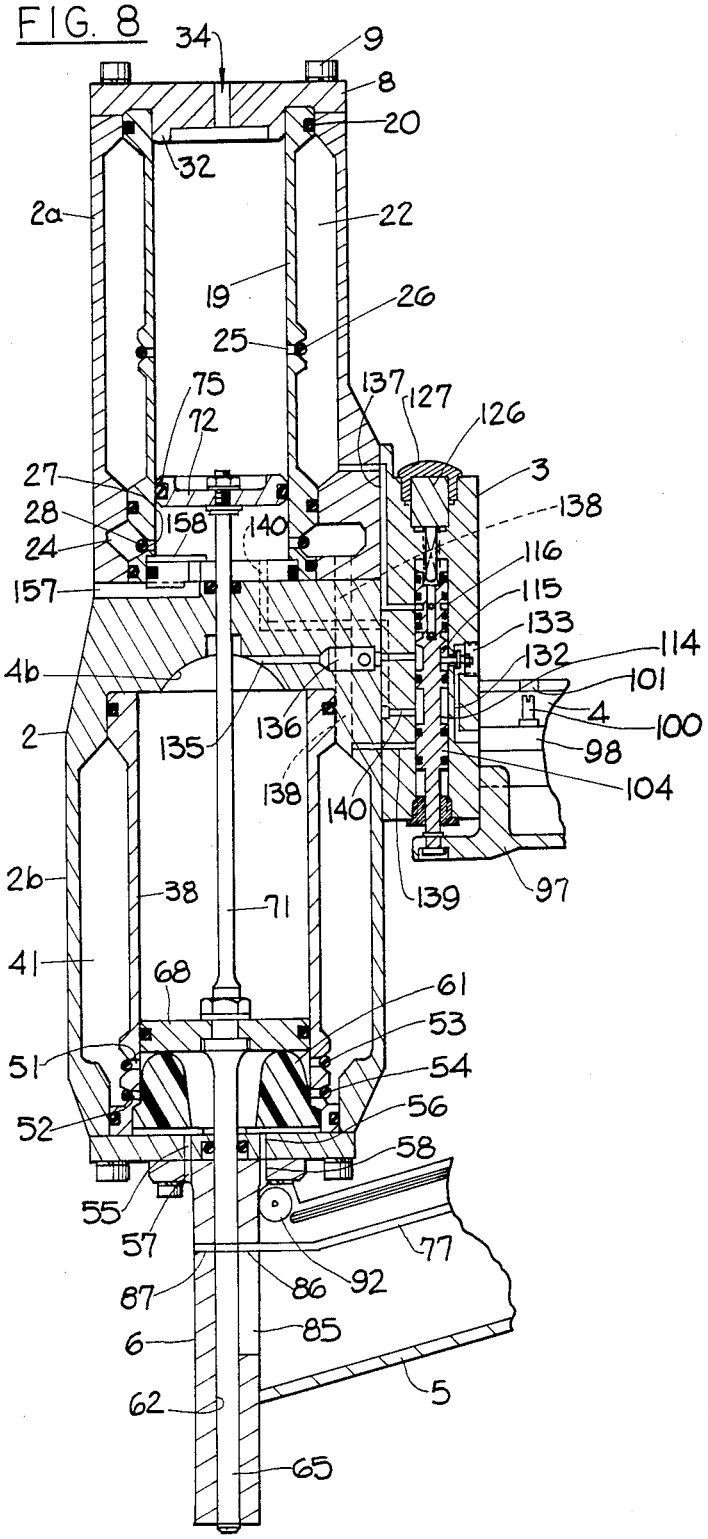
FIG. 8 is a fragmentary elevational cross-sectional view, similar to FIG. 6, illustrating the trigger and the main valve spool in their upper, actuated positions and the charging piston and driving piston in their lower actuated positions.

Reference is now made to FIGS. 8 and 9. When the spool 104 of the main valve reaches its uppermost position, the one-way fuel valve 133 and all of passages 139, 140, 135 and 137 will be closed. Simultaneously, the free end of the plunger 128 of the piezoelectric device 126 contacts the bottom of the main valve spool axial bore 117 and is shifted upwardly to actuate the piezoelectric device 126. This, in turn, actuates the spark plug 130 and ignites the air/fuel mixture in combustion chamber 46.

As a consequence, the lower piston 68 and driver 65 are shifted downwardly with considerable force. The driver, operating on the head of the stud 76 in drive track 62, severs the washer-like element 80 from the ribbon-like portions 79 and 78 of strip 77 and the stud is driven into the workpiece. The driver 65, its extension 71, lower piston 68 and upper piston 72 achieve the positions shown in FIG. 8. The energy of these elements, not consumed in driving the stud 76, is absorbed by the resilient bumper 61 at the bottom end of lower cylinder 38.

During the downward movement of upper piston 72, air within upper cylinder 19 and beneath piston 72 is compressed and forced through the passages 25 into combustion air chamber 22. O-ring 26 acts as a check valve or one-way valve for the passages 25 and the air is retained in the combustion air chamber 22 under pressure since the passage 137 is closed by the spool 104 of the main valve. Once the upper piston 72 has passed the passages 25, the remaining air within cylinder 19 and beneath the piston will enter the upper return air chamber 24 via passages 27 and check valve 28. Air beneath cylinder 72 will not pass through air inlet 157 by virtue of reed valve 158. Air will enter the upper cylinder 19 above piston 72 by virtue of air vent 34. In this way, downward movement of the upper piston 72 will not be hindered by the formation of a vacuum within upper cylinder 19 above upper piston 72.

In a similar fashion, as the lower piston 68 shifts downwardly toward bumper 61, air therebeneath will be forced through passages 51 and 52 and their check valves 53 and 54 into the lower return air chamber 41, remaining there under pressure since the passage 139 (communicating with the upper return air chamber 24 and lower return air chamber 41) is closed by the main valve stem 104. Air cannot escape through vents 55,57 and 56,58 at the lowermost end of lower cylinder 38, by virtue of reed valve 59.

Upon release of trigger 97, the main valve spool 104 will shift downwardly from its position shown in FIGS. 8 and 12, to its position shown in FIGS. 6 and 7.

When the trigger 97 is released, the main valve spool 104 moves downwardly rapidly under the influence of spring 125. As the main valve spool 104 descends to its normal, unactuated position, port 137 from combustion air chamber 22 and the one-way fuel valve 133 will both be momentarily opened. The amount of time these elements are open is very short and pressure within the lower cylinder 38 above lower piston 68 will preclude entrance of any appreciable amount of fuel or combustion air into combustion chamber 46. When the main valve stem 104 is in its lowermost, unactuated position (as shown in FIGS. 6 and 7), the passage 137 from the combustion air chamber 22 is closed, as is the one-way fuel valve 133. The passage 139, connected to the passage 138 from the upper return air chamber 24 and the lower return air chamber 41 is opened by the annular groove 114 of the main valve spool 104. The passage 140 is also opened by the same groove 114 in the main valve spool 104, thus the passage 139 is connected to the passage 140 and return air from chambers 24 and 41 enters upper cylinder 19 beneath upper piston 72, causing the upper piston 72 to return to its normal upper position shown in FIG. 6. This, of course, causes the lower piston 68 and the ram 65 to return to their normal upper positions, as viewed in FIG. 6.

During the upward movement of upper piston 72, the air above upper cylinder 72 exits via vent port 34. Meanwhile, ambient air may be drawn into the upper cylinder 19 below the upper piston 72 through the vent or port 157 and reed valve 158. In a similar fashion, ambient air enters ports 55,57 and 56,58 in the plate 10 and guide body 6, past reed valve 59, beneath the lower piston 68 and into lower cylinder 38. This assures that the upward movement of the driver 65, lower piston 68 and upper piston 72 is not hindered by the drawing of a vacuum in the lower cylinder 38 beneath lower piston 68 and in the upper cylinder 19 beneath upper piston 72.

When the driver and piston assembly is shifted upwardly by the return air from upper return air chamber 24 and lower return air chamber 41, some of the air from these chambers simultaneously enters the branch passage 141 to open the exhaust valve 142, as described with respect to FIG. 10. The exhaust valve 142 remains open during the upward movement of lower piston 68 enabling the products of combustion above the lower piston 68 and in the combustion chamber 46 to be exhausted through valve 142 and exhaust passage 144 (see FIG. 11).

When the upper piston 72, the lower piston 68 and the driver 65 reach their normal, unactuated, uppermost positions (as shown in FIGS. 6) the cycle is complete. With the driver 65 in its normal uppermost position, the feeder shoe 88 will shift the next stud 76 of strip 77 into the drive track 62, and the tool 1 is ready for its next actuation.

It will be understood by one skilled in the art that the tool 1 may be provided with various types of safety devices. For example, the trigger 97 may be disabled until a workpiece responsive trip (not shown), operatively connected thereto, is pressed against the workpiece to be nailed. Such arrangements are well-known in the art and do not constitute a part of the present invention.

It will be understood that the tool of the present invention may be held in any orientation during use.

Thus, words such as "upper", "lower", "upwardly", "downwardly", "vertical", and the like are used in the above description and in the claims in conjunction with the drawings for purposes of clarity, and are not intended to be limiting.

Modifications may be made in the invention without departing from the spirit of it. For example, the power output of the tool of the present invention can be varied, by changing the size of combustion chamber 46. It will be remembered that when fuel and combustion air are introduced into the combustion chamber during the firing cycle, the piston 68 and driver 65 shift slightly downwardly until the free end of the driver 65 contacts the head of the forwardmost stud in guide body 6. It will be apparent that the size of combustion chamber 46 is determined, in part, by the position of piston 68. Thus, if the forwardmost stud 76 in guide body 6 were slightly lowered, piston 68 and driver 65 would lower an equivalent amount, enlarging combustion chamber 45, the amount of air and fuel mixture it can contain, and thereby increasing the power of the tool.

Lowering the forwardmost stud 76 in guide body 6 can be accomplished by lowering the entire magazine 5 with respect to the remainder of the tool. This can be accomplished by making the attachment of the forward end of magazine 5 to guide body 6 an adjustable one. For example, the forward end of the magazine 82 could ride in a pair of tracks (one of which is shown at 159 in FIG. 6). Preferably, means (not shown) are provided to lock the forward end of magazine 5 in selected adjusted positions in the tracks. To this end, the opening 85 in the rearward portion of guide body 6 should be so sized as to enable the passage of studs therethrough in any of the preselected positions of magazine 5. Similarly, additional slots equivalent to slot 86 should be provided at selected positions in the guide body. Such additional slots are shown in FIG. 6 in broken lines at **86*a* and 86*b*. Additional slots equivalent to slots 87*a*–87*b* should be provided in the forward face of the guide body. Such additional slots are indicated in FIG. 6 at 87*c* and 87*d***.

Finally, bracket 14 supporting the rearward end of magazine 5 from handle portion 4 should be made adjustable in length. To this end, in FIG. 6 bracket 14 is shown as made up of a first portion **14*a* attached to handle portion 4 and a second, overlapping portion 14*b* affixed to the rearward end of the magazine, the bracket portions 14*a* and 14*b* will be provided with a plurality of corresponding perforations or a pair of elongated corresponding slots, for the receipt of a fastening means, generally indicated at 160, for maintaining bracket parts 14*a* and 14*b*** in any desired adjusted position with respect to each other.

When the size of combustion chamber 46 is enlarged in the manner just described, it will be necessary to appropriately adjust the pressure regulating needle valve 100 to appropriately change the fuel-air mixture. To this end, handle portion 4 of tool 1 may be provided with indicia indicating the proper settings for valve 100.

What we claim is:

1. A fastener driving tool comprising a tool body, upper and lower coaxial cylinders located within said tool body, each of said cylinders having upper and lower ends, upper and lower pistons located in said upper and lower cylinders respectively and fixedly mounted on a common driver forming a piston/driver assembly, said piston-driver assembly being shiftable between a normal retracted position and an extended fastener driving position, the upper end of said lower cylinder and said lower piston defining a combustion chamber, ignition means within said combustion chamber, a chamber in said tool body containing pressurized combustion air, at least one chamber in said body containing return air under pressure, a source of gaseous fuel under pressure within said body, and control means to introduce into said combustion chamber a measured air/fuel mixture from said combustion air chamber and said gaseous fuel source, to actuate said ignition means to combust said air/fuel mixture and thereby shift said piston-driver assembly from said normal retracted position to said extended fastener driving position, to introduce air from said at least one return air chamber to said upper cylinder beneath said upper piston to shift said piston/driver assembly from said extended fastener driving position to said normal retracted position and to exhaust spent products of combustion from said combustion chamber and lower cylinder, and means to replenish air under pressure in said combustion air chamber and said at least one return air chamber during shifting of said piston/driver assembly.

2. The fastener driving tool claimed in claim 1 including means for introducing ambient air into said upper cylinder above said upper piston to prevent the formation of a vacuum therein when said piston/driver assembly shifts from its normal retracted position to its extended fastener driving position, means in association with said upper cylinder and means in association with said lower cylinder to allow air to be withdrawn from beneath said upper piston and beneath said lower piston when said piston/driver assembly shifts from its normal retracted position to its extended fastener driving position, means in association with said upper cylinder to allow air to be withdrawn from above said upper piston when said piston/driver assembly shifts from its extended fastener driving position to said normal retracted position and means in association with said upper cylinder and means in association with said lower cylinder to introduce ambient air beneath said upper piston and beneath said lower piston when said piston/driver assembly shifts from its extended fastener driving position to its normal retracted position.

3. The fastener driving tool claimed in claim 2 wherein said means for introducing ambient air in said upper cylinder above said upper piston when said piston/driver assembly shifts from its normal retracted position to its extended fastener driving position and said means to allow air from said upper cylinder above said upper piston to be withdrawn therefrom when said piston/driver assembly shifts from its extended fastener driving position to its normal retracted position comprising at least one port at the upper end of said upper cylinder, said port being connected to atmosphere.

4. The fastener driving tool claimed in claim 2 wherein said means in association with said upper cylinder and said means in association with said lower cylinder to introduce ambient air beneath said upper and lower pistons when said piston/driver assembly shifts from its extended fastener driving position to its normal retracted position comprise respectively a check valved port at the lower end of said upper cylinder and a check valved port at the lower end of said lower cylinder, both of said last mentioned ports being connected to atmosphere.

5. The fastener driving tool claimed in claim 2 wherein said means to withdraw air from said upper cylinder below said upper piston when said piston/driver assembly shifts from its normal retracted position to its extended fastener driving position comprises at least one check valved port connected to said combustion air chamber to replenish air under pressure therein.

6. The fastener driving tool claimed in claim 2 wherein said means to withdraw air from said lower cylinder beneath said lower piston when said piston/driver assembly shifts from its normal retracted position to its extended fastener driving position comprises at least one check valved port connected to said at least one return air chamber to replenish air under pressure therein.

7. The fastener driving tool claimed in claim 1 wherein said source of gaseous fuel comprises a replaceable canister mounted in said body and containing said gaseous fuel under pressure, said canister being removably connectable to a conduit containing a pressure regulating needle valve and terminating in a one-way fuel valve associated with and actuable by said control means, said needle valve and said conduit between said needle valve and said one-way fuel valve defining a measured quantity of said gaseous fuel.

8. The fastener driving tool claimed in claim 4 including a magazine, a plurality of fasteners in said magazine and means to advance said fasteners in said magazine to locate the forwardmost fastener therein beneath said piston/driver assembly at the end of each tool cycle, said forwardmost fastener comprising a stop for said piston/driver assembly positioning said piston/driver assembly upon introduction of said air/fuel mixture into said combustion chamber to determine the size of said combustion chamber, means to shift said magazine and thus said forwardmost fastener with respect to said tool in directions parallel to the longitudinal axis of said piston/driver assembly to adjust the size of said combustion chamber, said needle valve comprising means to adjust said air/fuel mixture, whereby the power of said tool can be varied.

9. The fastener driving tool claimed in claim 1 including a passage from said combustion chamber to exhaust, a normally closed exhaust valve in said exhaust passage, and wherein said control means comprises a control spool valve and a manual trigger, said manual trigger and control valve spool being shiftable between an unactuated position and an actuated position, means biasing said spool and trigger to said unactuated position, a passage connecting said control valve to said combustion air chamber, a passage connecting said control valve to said at least one return air chamber, a passage from said control valve having a first branch extending to the lower end of said upper cylinder and a second branch extending to said exhaust valve, a passage connecting said control valve to said combustion chamber, a check valve mounted in said combustion chamber-control valve passage permitting the passage of air and fuel only from said control valve to said combustion chamber, said one-way fuel valve and said piezoelectric device being so positioned as to be actuated by said spool, said control valve spool being so configured that when shifted from its unactuated position to its actuated position it actuates said fuel valve and introduces said measured quantity of gaseous fuel into said combustion chamber, it thereafter introduces air from said combustion air chamber to said combustion chamber and it thereafter activates said piezoelectric device and thus said spark plug igniting said air/fuel mixture in said combustion chamber shifting said piston/driver assembly from its normal retracted position to its extended fastener driving position, said control valve spool being further configured such that when shifted from its actuated to its unactuated position it introduces air from said at least one return air chamber to said upper cylinder beneath said upper piston to shift said piston/driver assembly from its extended fastener driving position to its normal retracted position and connects air from said at least one return air chamber to said exhaust valve to open said exhaust valve to exhaust spent products of combustion from said lower cylinder and said combustion chamber through said exhaust passage.

10. The fastener driving tool claimed in claim 1 wherein said means to replenish air under pressure in said combustion air chamber comprises at least one check valved port in said upper cylinder communicating with said combustion air chamber and permitting air beneath said upper piston to enter said combustion air chamber when said piston/driver assembly is shifted from its normal retracted position to its extended fastener driving position.

11. The fastener driving tool claimed in claim 1 wherein said means to replenish air under pressure in said at least one return air chamber comprises at least one check valved port in said lower cylinder communicating with said return air chamber and permitting air beneath said lower piston to enter said return air chamber when said piston/driver assembly is shifted from its normal retracted position to its extended fastener driving position.

12. The fastener driving tool claimed in claim 1 including a second return air chamber and a passage between said two return air chambers.

13. The fastener driving tool claimed in claim 1 including a magazine, a plurality of fasteners in said magazine, and means to advance said fasteners in said magazine to locate the forwardmost fastener therein beneath said piston/driver assembly at the end of each tool cycle.

14. The fastener driving tool claimed in claim 1 wherein said air/fuel mixture in said combustion chamber is at a high compression ratio of at least about 4:1.

15. The fastener driving tool claimed in claim 14 including a plurality of washer-like elements each having a central hole, each of said fasteners being headed and mounted in said central hole of one of said washer-like elements and being supported by its respective washer-like element, frangible means connecting said washer-like elements and forming a strip of said washer-like elements and their respective fasteners, whereby when each fastener is driven into a workpiece it will have its respective washer-like element beneath its head.

16. The fastener driving tool claimed in claim 1 wherein said air-fuel mixture in said combustion chamber is at a high compression ratio of at least about 6:1.

17. The fastener driving tool claimed in claim 1 including means to adjust the size of said combustion chamber and means to adjust said air/fuel mixture, whereby to adjust the power of said tool.

18. The fastener driving tool claimed in claim 1 wherein ignition means comprises a spark plug mounted in said combustion chamber electrically connected to a piezoelectric device actuable by said control means.

19. The fastener driving tool claimed in claim 3 wherein said source of gaseous fuel comprises a replaceable canister mounted in said body and containing said gaseous fuel under pressure, said canister being removably connectable to a conduit containing a pressure regulating needle valve and terminating in a one-way fuel valve associated with and actuable by said control means, said conduit between said needle valve and said one-way fuel valve defining a measured quantity of said gaseous fuel.

20. The fastener driving tool claimed in claim 19 including a passage from said combustion chamber to exhaust, a normally closed exhaust valve in said exhaust passage, and wherein said control means comprises a control spool valve and a manual trigger, said manual trigger and control valve spool being shiftable between an unactuated position and an actuated position, means biasing said spool and trigger to said unactuated position, a passage connecting said control valve to said combustion air chamber, a passage connecting said control valve to said at least one return air chamber, a passage from said control valve having a first branch extending to the lower end of said upper cylinder and a second branch extending to said exhaust valve, a passage connecting said control valve to said combustion chamber, a check valve mounted in said combustion chamber-control valve passage permitting the passage of air and fuel only from said control valve to said combustion chamber, said one-way fuel valve and said piezoelectric device being so positioned as to be actuated by said spool, said control valve spool being so configured that when shifted from its unactuated position to its actuated position it actuates said fuel valve and introduces said measured quantity of gaseous fuel into said combustion chamber, it thereafter introduces air from said combustion air chamber to said combustion chamber and it thereafter activates said piezoelectric device and thus said spark plug igniting said air/fuel mixture in said combustion chamber shifting said piston/driver assembly from its normal retracted position to its extended fastener driving position, said control valve spool being further configured such that when shifted from its actuated to its unactuated position it introduces air from said at least one return air chamber to said upper cylinder beneath said upper piston to shift said piston/driver assembly from its extended fastener driving position to its normal retracted position and connects air from said at least one return air chamber to said exhaust valve to open said exhaust valve to exhaust spent products of combustion from said lower cylinder and said combustion chamber through said exhaust passage.

21. The fastener driving tool claimed in claim 20 wherein said tool body comprises a main housing having upper and lower portions containing said upper and lower cylinders respectively, said combustion air chamber and said at least one return air chamber being located in said main housing, a main valve housing affixed to said main housing and containing said main control valve, said piezoelectric device and said one-way fuel valve, a handle attached to said main valve housing, said handle supporting said manual trigger, said handle being hollow and containing said gaseous fuel canister, a guide body affixed to and below said lower portion of said main housing, said guide body having a drive track therein configured to guide said driver of said piston/driver assembly and to receive a fastener to be driven by said driver.

22. The fastener driving tool claimed in claim 21 including a magazine containing a plurality of fasteners, said magazine having a forward end communicating with and supported by said guide body, said magazine having a rearward end, bracket means depending from said handle and supporting said rearward end of said magazine, and means in association with said magazine to advance said fasteners therein and locate the forwardmost fastener in said guide body beneath said driver at the end of each tool cycle.

23. The fastener driving tool claimed in claim 21 wherein said upper portion of said main housing and said upper cylinder define said combustion air chamber surrounding said upper cylinder, said lower portion of said main housing and said lower cylinder defining said at least one return air chamber surrounding said lower cylinder.

24. The fastener driving tool claimed in claim 23 including a second return air chamber, said upper cylinder and said upper portion of said main housing defining said second return air chamber surrounding said upper cylinder below said combustion air chamber, passage means connecting said two return air chambers.

25. The fastener driving tool claimed in claim 24 including means for introducing ambient air into said upper cylinder above said upper piston to prevent the formation of a vacuum therein when said piston/driver assembly shifts from its normal retracted position to its extended fastener driving position, means in association with said upper cylinder and means in association with said lower cylinder to allow air to be withdrawn from beneath said upper piston and beneath said lower piston when said piston/driver assembly shifts from its normal retracted position to its extended fastener driving position, means in association with said upper cylinder to allow air to be withdrawn from above said upper piston when said piston/driver assembly shifts from its extended fastener driving position to said normal retracted position and means in association with said upper cylinder and means in association with said lower cylinder to introduce ambient air beneath said upper piston and beneath said lower piston when said piston/driver assembly shifts from its extended fastener driving position to its normal retracted position.

26. The fastener driving tool claimed in claim 25 wherein said means for introducing ambient air in said upper cylinder above said upper piston when said piston/driver assembly shifts from its normal retracted position to its extended fastener driving position and said means to allow air from said upper cylinder above said upper piston to be withdrawn therefrom when said piston/driver assembly shifts from its extended fastener driving position to its normal retracted position comprises at least one port at the upper end of said upper cylinder, said port being connected to atmosphere.

27. The fastener driving tool claimed in claim 25 wherein said means in association with said upper cylinder and said means in association with said lower cylinder to introduce ambient air beneath said upper and lower pistons when said piston/driver assembly shifts from its extended fastener driving position to its normal retracted position comprise respectively a check valved port at the lower end of said upper cylinder and a check valved port at said lower end of said lower cylinder, both of said last mentioned ports being connected to atmosphere.

28. The fastener driving tool claimed in claim 25 wherein said means to withdraw air from said upper cylinder below said upper piston when said piston/driver assembly shifts from its normal retracted position to its extended fastener driving position comprises at least one check valved port connected to said combustion air chamber to replenish air under pressure therein, and at least one check valved port connected to said second return air chamber to replenish air under pressure therein.

29. The fastener driving tool claimed in claim 25 wherein said means to withdraw air from said lower cylinder beneath said lower piston when said piston/-driver assembly shifts from its normal retracted position to its extended fastener driving position comprises at least one check valved port connected to said return air chamber surrounding said lower cylinder to replenish air under pressure therein.

30. The fastener driving tool claimed in claim 25 including means to adjust the size of said combustion chamber and means to adjust said air/fuel mixture, whereby to adjust the power of said tool.

31. The fastener driving tool claimed in claim 25 wherein said air/fuel mixture in said combustion chamber is at a high compression ratio of at least about 4:1.

32. The fastener driving tool claimed in claim 25 wherein said air/fuel mixture in said combustion chamber is at a high compression ratio of at least about 6:1.

33. The fastener driving tool claimed in claim 25 including a plurality of washer-like elements each having a central hole, each of said fasteners being headed and mounted in said central hole of one of said washer-like elements and being supported by its respective washer-like element, frangible means connecting said washer-like elements and forming a stip of said washer-like elements and their respective fasteners, whereby when each fastener is driven into a workpiece it will have its respective washer-like element beneath its head.

34. The fastener driving tool claimed in claim 25 including a magazine, a plurality of fasteners in said magazine and means to advance said fasteners in said magazine to locate the forwardmost fastener therein beneath said piston/driver assembly at the end of each tool cycle, said forwardmost fastener comprising a stop for said piston/driver assembly positioning said piston/-driver assembly upon introduction of said air/fuel mixture into said combustion chamber to determine the size of said combustion chamber, means to shift said magazine and thus said forwardmost fastener with respect to said tool in directions parallel to the longitudinal axis of said piston/driver assembly to adjust the size of said combustion chamber, said needle valve comprising means to adjust said air/fuel mixture, whereby the power of said tool can be varied.

* * * * *